US008844617B1

(12) United States Patent
Baker

(10) Patent No.: US 8,844,617 B1
(45) Date of Patent: Sep. 30, 2014

(54) ANNULAR BLOWOUT CONTAINER (ABOC)

(71) Applicant: Dwight Baker, Eagle Pass, TX (US)

(72) Inventor: Dwight Baker, Eagle Pass, TX (US)

( * ) Notice: Subject to any disclaimer, the term of this patent is extended or adjusted under 35 U.S.C. 154(b) by 0 days.

(21) Appl. No.: 14/183,385

(22) Filed: Feb. 18, 2014

Related U.S. Application Data

(60) Provisional application No. 61/765,895, filed on Feb. 18, 2013.

(51) Int. Cl.
*E21B 33/06* (2006.01)
*E21B 33/08* (2006.01)

(52) U.S. Cl.
CPC ..... *E21B 33/06* (2013.01); *E21B 33/085* (2013.01)
USPC ..... 166/84.3; 166/78.1; 251/1.2; 277/326

(58) Field of Classification Search
CPC ..... E21B 33/085
USPC ..... 166/84.3, 85.4, 78.1; 251/1.1–1.2; 277/324, 326
See application file for complete search history.

(56) References Cited

U.S. PATENT DOCUMENTS

| | | | |
|---|---|---|---|
| 3,837,356 | A | 9/1974 | Selep et al. |
| 4,529,169 | A | 7/1985 | Johns et al. |
| 4,997,162 | A | 3/1991 | Baker et al. |
| 5,143,348 | A | 9/1992 | Baker et al. |
| 5,211,373 | A | 5/1993 | Baker |
| 5,377,955 | A | 1/1995 | Baker |
| 2011/0297396 | A1 | 12/2011 | Hendel et al. |
| 2013/0126153 | A1 | 5/2013 | Baker |
| 2013/0220631 | A1 | 8/2013 | Wilie |

FOREIGN PATENT DOCUMENTS

GB 2304860 A 3/1997

*Primary Examiner* — Giovanna Wright
(74) *Attorney, Agent, or Firm* — Kammer Browning PLLC

(57) ABSTRACT

An annular blowout container (ABOC) that may be used in multiples in a stack in conjunction with additional gate and shear valves to protect a wellhead. The ABOC incorporates a cylindrical formed bladder that provides a tight constrictive seal around whatever pipe or tubing may be in the well bore. The bladder is made of top and bottom rotator plates with springs extending between the plates. The springs are encased in Teflon® and held in place by Kevlar® then covered over completely with cured Viton® that is injected to complete the overall bladder in a molded form. Rotation of the top and bottom rotator plates effects a twisting constriction around the drill pipe or tubing. Electrical and hydraulic operational components are housed inside chambers within the ABOC for predominantly self-contained operation. The cylindrical bladder assembly may be removed and replaced after extended use.

1 Claim, 6 Drawing Sheets

ANNULAR BLOWOUT CONTAINER (ABOC)

CROSS REFERENCES TO RELATED APPLICATIONS

This application claims the benefit under Title 35 United States Code §119(e) of U.S. Provisional Application 61/765,895 filed Feb. 18, 2013 the full disclosure of which is incorporated herein by reference.

BACKGROUND OF THE INVENTION

1. Field of the Invention

The present invention relates generally to valves, and more particularly, but not by way of limitation, to a constriction valve for controlling the flow of fluids from a well, especially during uncontrolled well blowouts. The present invention more specifically relates to devices for constricting around and closing off the annular flow volume surrounding a pipe or tubing present in a well. The present invention may therefore be described as an annular blowout container (ABOC) and therefore relates to an improved constriction valve for controlling the flow of drilling fluids and hydrocarbon fluids and gases in a state of free flow known as blowout in drilling and production phases, in combination with additional valves that may be positioned at the well head.

2. Description of the Related Art

The control and containment of free flowing fluids, hydrocarbon fluids and gases in well drilling and production operations is critical. There are a wide variety of blowout preventers (BOPS) but these have a long history of failure. In particular, various types of shear rams commonly used today are hydraulically operated and are typically only designed to cut the tube section of the drill pipe being used, not to stop the flow of fluids. In addition, shear rams rely for proper placement and function on the drill pipe being in a center position of the hole to cut or sever the drill pipe tube only. Most blowouts, however, occur during the tripping phase of drilling, and as a result, other drilling tools such as drill collars and/or downhole tools are frequently within the section to be closed.

A further significant cause of failure of blowout preventers used today results from the fact that typically only the body of the BOP is tested at API recommended pressures. The internal components of BOPs used today rely on elastomeric components installed in grooves to make contact with the body of the valve. These elastomeric components will generally not contain higher pressures above 5,000 psi. Therefore, the BOPs in use today are significantly overrated for use in conjunction with higher pressures.

SUMMARY OF THE INVENTION

The present invention provides an annular blowout container (ABOC) that may be used in conjunction with one or more additional standard blowout containers (BOCs). The ABOC of the present invention incorporates a bladder of approximately 7-10 feet in height that provides approximately 3.5-4.5 feet of tight constrictive seal around whatever pipe or tubing may be in the well bore. The bladder is made of top and bottom rotator plates with springs extending between the plates. The springs are encased in Teflon® and held in place by Kevlar® then covered over completely while in a form with liquid Viton® that is injected to complete the overall bladder in a molded form.

These molded bladders may be removed and replaced in the ABOC by removing the top section of the valve housing and twisting out the bladder assembly. Inside the ABOC body are two cavities, one for holding hydraulic oil and the electrically driven hydraulic pump needed for power to activate the rotators, and the second is utilized for holding the batteries in the self contained system.

The top and bottom rotator plates are moved in a counter-revolutionary manner as they are affixed to the bladder so as to twist and constrict the bladder to a full grip and sure seal against the pipe or tubing that is in the drill string. The flexible form of the bladder allows it to constrict around irregular components such as collars on the drill string without sacrificing the tightness of seal. The rotators turn the bladder approximately one-quarter of a turn or slightly more to collapse the bladder to the outside diameter of the object in the drill string. This quick rotator action therefore provides the time necessary to get the blowout stopped or stalled out so that heavy mud can be pumped down the hole to stop the pressure at its source. The present ram type BOPs are generally antiquated in that they rely on seals to hold back rated pressures of the fluid flow when in fact the rubber type seals are only rated for up to 5,000 psi and the BOP bodies are open to returning gases, fluids, and solids coming from the drilled hole. These existing BOPs are generally overly complex and rely on the rig as a source for hydraulic oil pressure to activate.

The internal bladder in the ABOC of the present invention contains rows of springs that are arranged and placed in between the two steel upper and lower rotator plates. The plates are preferably circular with an internal aperture that is required for the ABOC to be fully open for drilling and/or production purposes. The arrangement of the holes drilled in the plates for installation of the springs are preferably in a circular pattern with the holes being drilled progressing towards the center in a circular pattern toward an inside diameter. A preferred embodiment has four concentric rings of apertures forming attachment points for the springs suspended between the rotating plates. The springs are preferably made in the manner of rebar with external ridges for internal holding power. The springs are preferably constructed from prime steel suitable for spring making. For severe service the springs may be made using suitable alloys that will withstand hydrogen sulfide and carbon dioxide gases, as well as other severe service environments. After the springs are cut to length and heat treated, they are put through a coating process with a first coating of a Teflon® based mixture applied. This first coating is preferably a mixture of Teflon® and other materials that allow the Teflon® to flex and stretch as needed in the compression cycle of the valve. Over the Teflon® mixture coating, a second layer of coating in the form of a Kevlar® mixture is applied. The springs are then installed between the top and bottom plates affixing each end to form the basic bladder. Once the basic bladder has been completed in this manner, it is placed in a mold with the outside diameter and the inside diameters set as needed for the geometry of the valve. Pressurized Viton® is then pumped in and allowed to cure, filling the spaces between the coated springs and inside the mold containment.

The upper bladder plate section is attached to the top rotator assembly inside the ABOC. Likewise, the lower section of the bladder plate is attached to the bottom rotator assembly. The function of the rotators is to turn the bottom and top plates in a counter-revolutionary direction a quarter turn or more for each action. When the rotator plates are thus turned, the bladder will compress towards the center contacting and pressing against whatever tube or pipe is in the hole opening. This compression seals off the bottom from the top as a constrictive valve. The molded in Viton® will compress, but is resistant to tear or being shredded. Extreme high flowing gases, liquids and solids can be stalled out (slowed down) for a significant time using the ABOC bladder while other drilling blowout measures are used to load the hole with more drilling fluids that can then be pumped down the drill pipe. The bottom rotator assembly is designed to allow the plate to move up as the twisting action on the bladder is applied. As the height of the bladder is shortened on twisting compression, one portion of the assembly (the top or bottom rotator plate) must be allowed to move towards the center of the assembly.

The hydraulic oil contained on the back side of the bladder is compressed further as piston mechanisms move up into the hydraulic fluid. In the same manner, the high pressure gases and fluids enter into a piston assembly under the bottom rotator plate that will additionally compress the hydraulic fluid, thus increasing the pressure on the back side of the bladder sealing element, and further facilitating the force with which the bladder constricts against the tube or pipe.

The height of the springs before attaching all of the hardware in the construction of the bladder is preferably about 7-10 feet. Tests show that approximately one-third of the spring section will provide a seal tight grip around the tube or pipe within the center of the bladder assembly. The rotator plates are preferably driven by a number of worm gear drive assemblies through either a direct linkage to the edge of the plate (formed with gear teeth) or through a gear coupling connecting to the hydraulic fluid pumps.

DETAILED DESCRIPTION OF THE PREFERRED EMBODIMENTS

Figure 1:
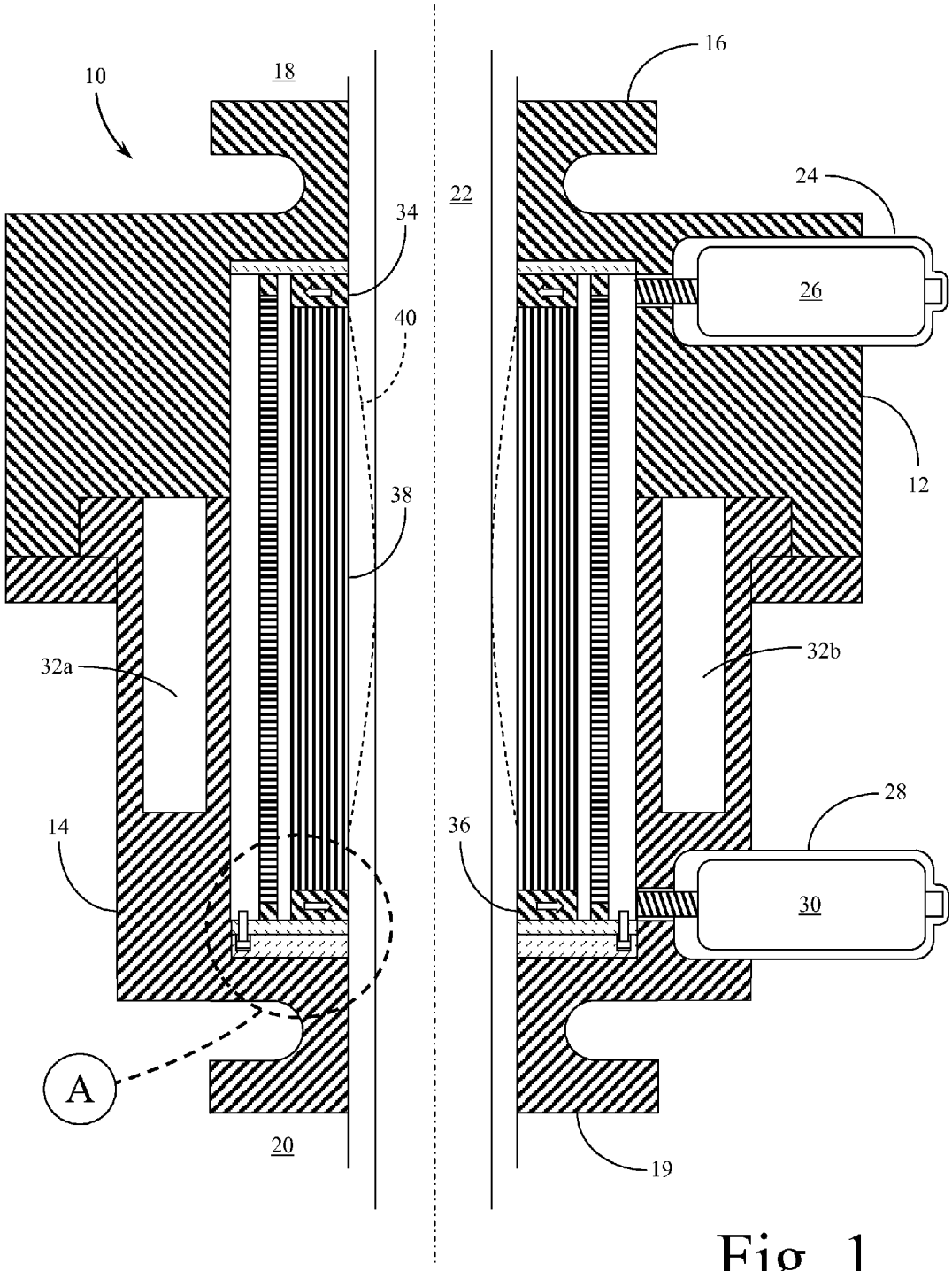
FIG. 1 is a partial cross-sectional view of the annular blowout container (ABOC) device of the present invention shown with a section of pipe or tubing positioned through the center bore of the assembly.

Reference is made first to FIG. 1 for a detailed description of the internal structures of the ABOC device of the present invention. Annular blowout container 10 shown in cross-section in FIG. 1 is constructed primarily of top section body 12 and bottom section body 14. Top connector flange 16 connects the ABOC to the upper wellhead assembly (the balance of the components) and bottom connector flange 19 attaches the ABOC to the lower wellhead assembly 20. Various secure means for connecting top section body 12 to bottom section body 14, such as the use of a radial array of tapered bolts, may be implemented.

A section of drill pipe 22 is shown positioned within the ABOC central bore, although it will be recognized that the tubular component within the bore may be drill pipe or production tubing. Positioned within top section body 12 is top drive assembly 24 which incorporates top drive motor 26. This drive assembly serves to rotate the top rotator disc 34 as described in more detail below. Associated with bottom section body 14 is bottom drive assembly 28 incorporating bottom drive motor 30. This assembly serves to counter-rotate bottom rotator disc 36.

The counter-rotation of top rotator disc 34 and bottom rotator disc 36 serves to twist and constrict bladder assembly 38 (shown in a relaxed condition in FIG. 1). When constricted, the bladder assembly has a profile 40 (dashed line) whereby a seal is created against drill pipe 22.

Also within bottom section body 14 are power supply and instrument chamber 32*a* and hydraulic supply chamber 32*b*. Power supply and instrument chamber 32*a* contains the necessary electrical batteries to operate the hydraulic pumps that in turn operate top drive motor 26 and bottom drive motor 30. Also within chamber 32*a* are control electronics and instrumentation connected externally (preferably through a hot stab connection) to the ABOC that allows for both monitoring of the condition of the ABOC and its remote control. In chamber 32*b*, both a hydraulic fluid reservoir and the necessary electrically driven hydraulic pumps provide the high pressure hydraulics required to operate the top drive assembly 24 and the bottom drive assembly 28. Each of the chambers shown may comprise multiple chambers radially arrayed about the center bore of bottom section body 14. The use of these chambers to hold and house the various operational and control elements of the ABOC eliminates much of the external connections (hydraulic and electrical) that are normally required for such valves.

Figure 3:
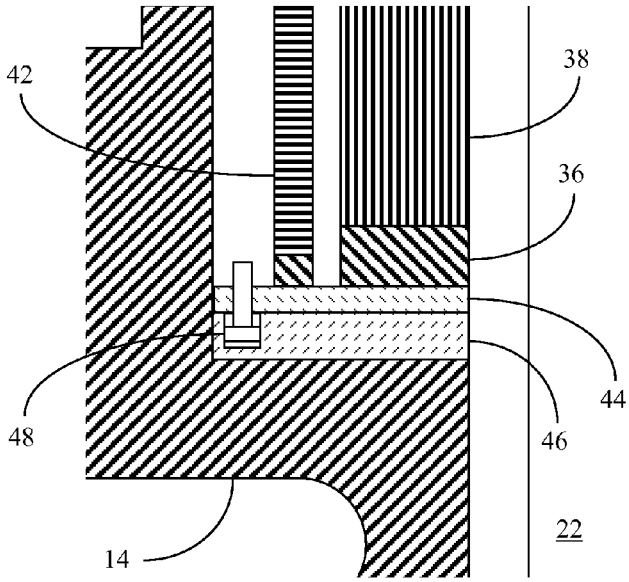
FIG. 3 is a detailed cross-sectional view of one edge of the lower rotator plate of the bladder assembly of the present invention showing the manner in which pressurized fluids may flow behind (to the outside of) the bladder wall to facilitate its compression against the interior pipe or tubing.

Additional detail highlighted by Detail Section A is described in conjunction with FIG. 3 and is associated with the operation of a back pressure hydraulic fluid system that facilitates the maintenance of the seal of the bladder against the drill pipe.

Figure 2:
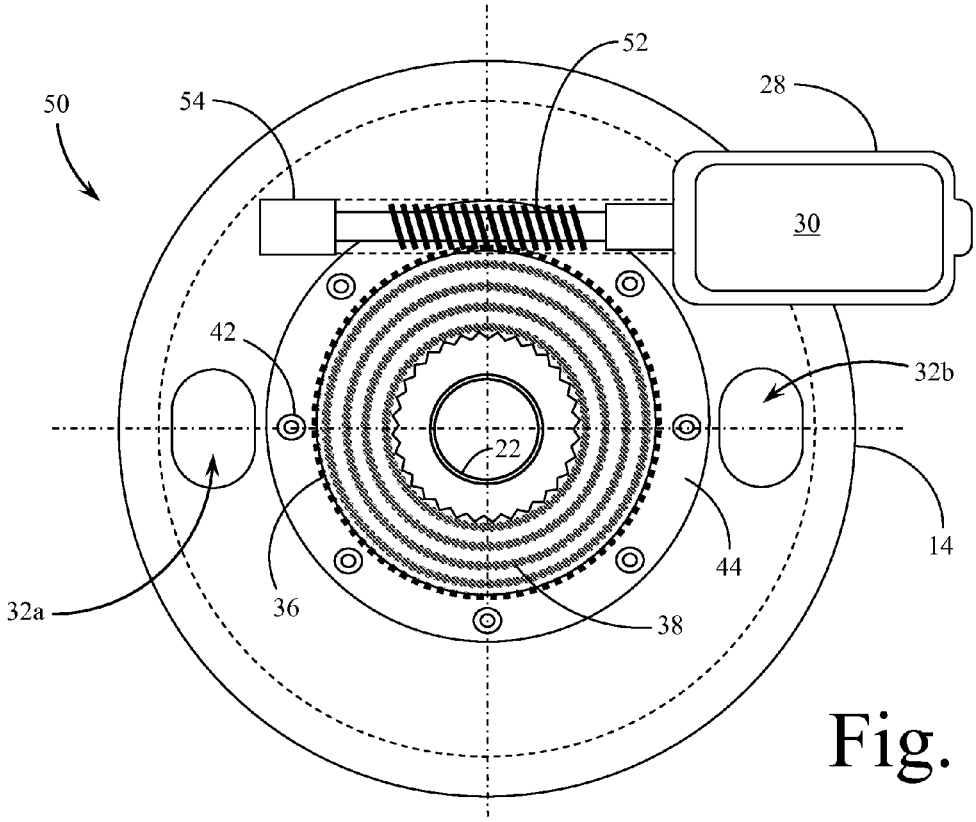
FIG. 2 is a partial cross-sectional view through the middle of the annular blowout container assembly showing one of the two rotator plates in conjunction with the surrounding valve body, as well as one of the two rotating drive mechanisms.

FIG. 2 shows a partial cross-sectional view looking down on lower valve assembly 50 primarily structured within bottom section body 14. In this view, drill pipe 22 is shown positioned in the central bore surrounded by bladder assembly 38. Bladder assembly 38 is positioned integrally with rotator disc 36 (having a gear tooth edge). An array of alignment back springs 42 are positioned around bladder assembly 38 in a manner that allows the assembly to return to an unconstricted configuration after activation. These alignment back springs 42 are positioned on top set plate 44 in a manner described in detail below with reference to FIG. 3.

Rotator disc 36 is turned (counter to the rotation of the top rotator disc 34) by means of bottom drive assembly 28. Bottom drive motor 30 turns worm gear drive shaft 52 set in position to engage the gear tooth edge of rotator disc 36 and held in place by drive bearing 54. Power supply and instrument chamber 32*a* and hydraulic supply chamber 32*b* are shown from above in the view of FIG. 2.

FIG. 3 shows the Detail Section A referenced in FIG. 1. Bladder assembly 38 is shown mounted in conjunction with rotator disc 36 that is itself positioned on top set plate 44 and bottom set plate 46. Alignment back springs 42 are affixed to top set plate 44 and again provide the necessary return force to re-position and re-set the configuration of bladder assembly 38 after use. Intensifier pistons 48 provide a means for conducting high pressure hydraulic fluids to the back side of bladder assembly 38 so as to augment the constrictive force associated with the twisting of the bladder around drill pipe 22. All of these components are configured within bottom section body 14 and are mirrored in other radial directions about the center bore of the assembly. The upper and lower plates that hold the integrated parts of the bladder together will preferably have O-ring grooves cut to width and depth to hold large diameter and high pressure Viton® O-rings. This would insure a tight seal during installation of the bladder. Such O-ring use, even in very high pressure environments has been proven in the industry.

Figure 4:
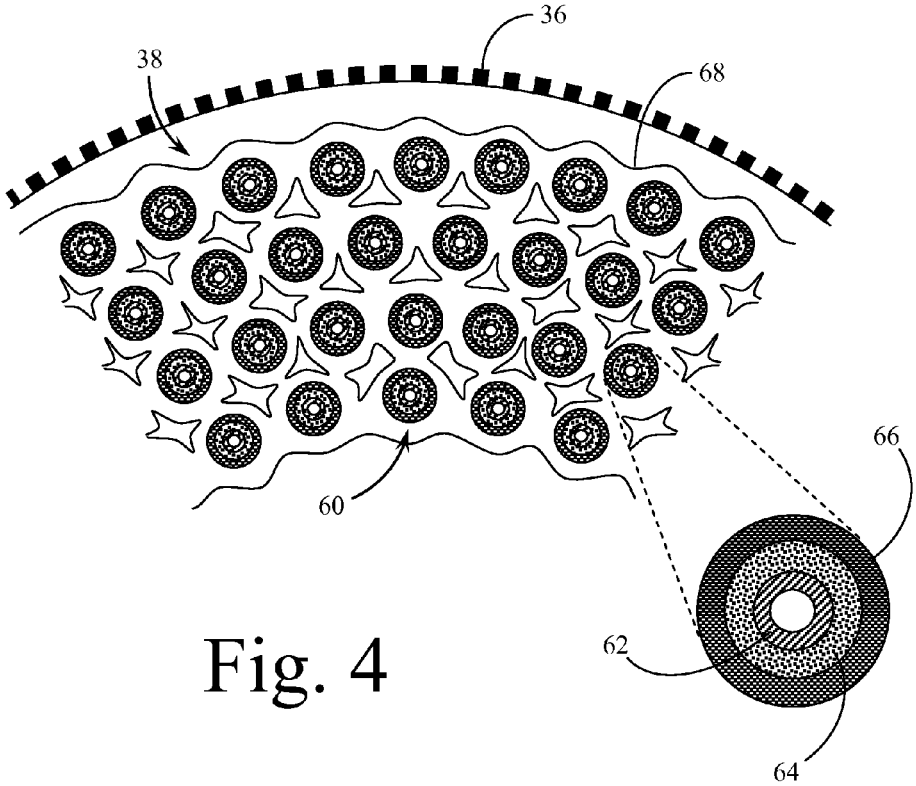
FIG. 4 is a detailed cross-sectional view of a portion of the spring assembly making up a part of the structure of the bladder assembly and the various layers associated with each individual spring and the overall assembly.

FIG. 4 displays in greater detail the internal construction of bladder assembly 38. In the expanded detail shown in FIG. 4, each individual steel spring 62 is shown to comprise Teflon® layer 64 surrounded by Kevlar® layer 66. The entire array of springs 62 is then assembled on rotator disc 36 (and rotator disc 34, shown in FIG. 1) in an array of four concentric circles in the preferred embodiment and positioned within a mold. Liquid Viton® is injected to fill the spaces between the springs to form Viton® layer 68. This produces flexible bladder wall 60 which, when constricted, seals against the drill pipe or tubing.

Figure 5:
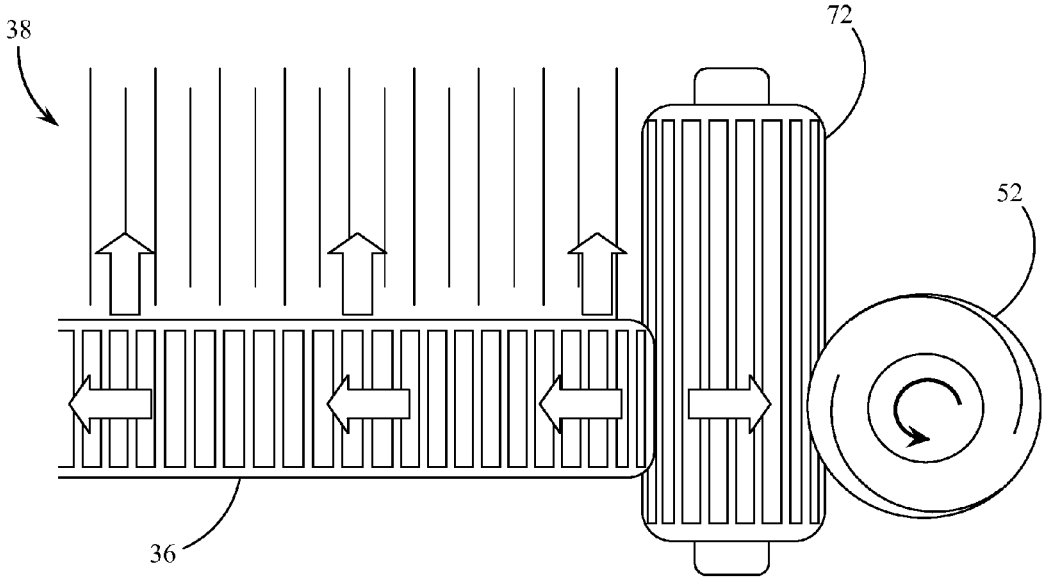
FIG. 5 is a detailed side plan view of one manner of translating the rotational worm gear drive to one of the rotator plates of the bladder assembly designed to move laterally (upwards) on constriction.

FIG. 5 shows in greater detail one manner of allowing for the movement of rotator disc 36 laterally (upward) when bladder assembly 38 is constricted. As worm gear drive shaft 52 turns, it causes the rotation of vertical slide gear 72 which in turn rotates rotator disc 36 through its gear tooth edge. Because of the greater width (height) of vertical slide gear 72, rotator disc 36 may move upward upon the constriction of bladder assembly 38 while still maintaining contact with the gear teeth of slide gear 72. This eliminates the necessity of adapting worm gear drive shaft 52 to accommodate the lateral movement of rotator disc 36.

Figure 6A:
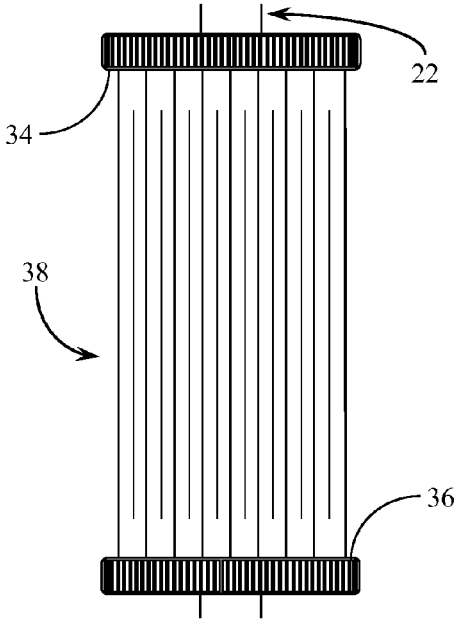
FIG. 6A is an elevational view of the bladder assembly of the present invention shown in an unconstricted configuration.
Figure 6B:
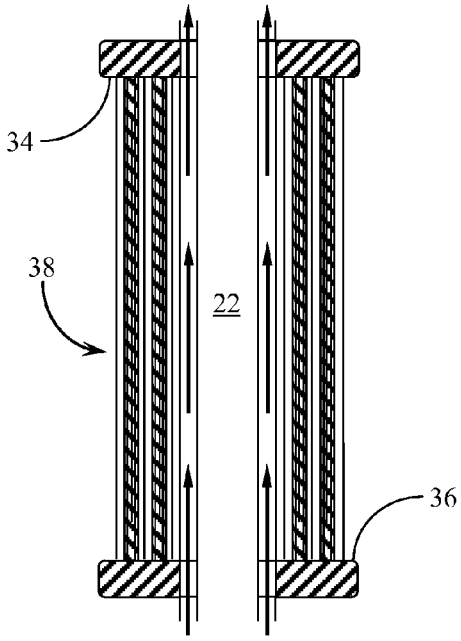
FIG. 6B is a cross-sectional view of the unconstricted bladder assembly of the present invention shown in FIG. 6A.
Figure 7A:
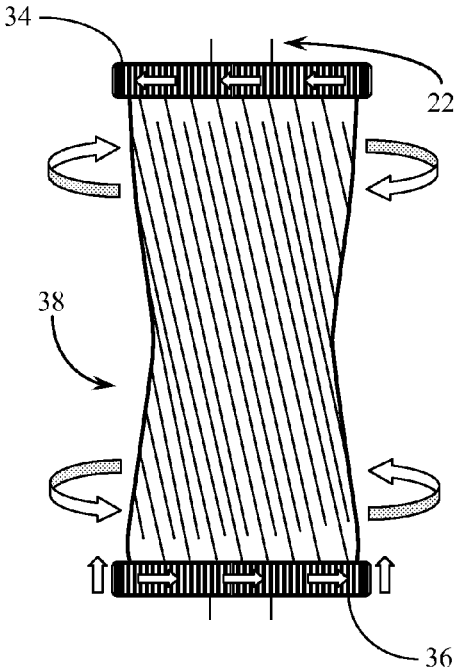
FIG. 7A is an elevational view of the bladder assembly of the present invention shown with rotator plates counter-rotated and with the assembly in an overall constricted configuration.
Figure 7B:
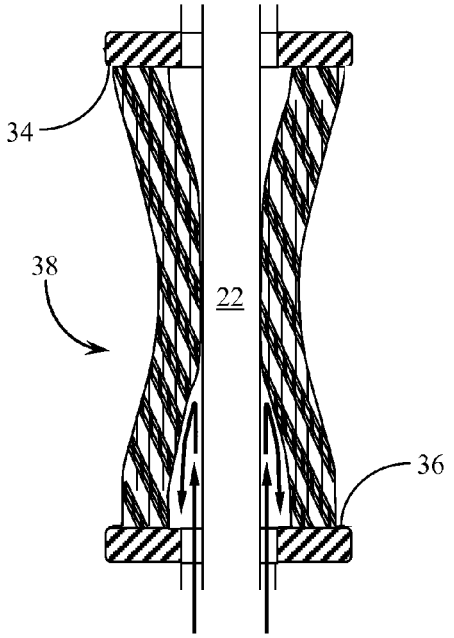
FIG. 7B is a cross-sectional view of the constricted bladder assembly of the present invention shown in FIG. 7A.

FIGS. 6A & 6B as well as FIGS. 7A & 7B show the functionality of the bladder assembly of the present invention. FIG. 6A shows an external view of the unconstricted bladder assembly 38 having top rotator disc 34 and bottom rotator disc 36 all of which surround drill pipe 22. FIG. 6B shows these same components internally (in cross-section) and demonstrates the manner in which the annular space around drill pipe 22 permits the flow of fluids (in either direction) through the open bladder assembly and therefore through the ABOC. FIG. 7A shows an external view of bladder assembly 38 after the counter-rotation of top rotator disc 34 and bottom rotator disc 36. It is also noted that bottom rotator disc 36 moves upward during the constriction process. This counter-rotation around drill pipe 22 causes the mid-section of bladder assembly 38 to decrease in both its inside diameter and its outside diameter. The constriction of the inside diameter, of course, provides the necessary seal against drill pipe 22 as shown in FIG. 7B. The degree to which this seal applies force against drill pipe 22 is in part a function of the degree to which rotator discs 34 & 36 have been counter-rotated. One quarter (90°) turn of each disc will effectively provide a seal that extends over approximately one-third of the overall height of bladder assembly 38.

Repeated use of the same bladder is anticipated both in testing and in actual operations. Despite the capacity to be repeatedly operated, the components of the ABOC that are subject to degradation over time are still primarily confined to the replaceable bladder. In this manner, the ABOC of the present invention may, after an extended period of use, be easily re-built by replacing the bladder assembly and the soft seal components. The hard steel components of the device will need little in the way of replacement or maintenance.

Figure 8:
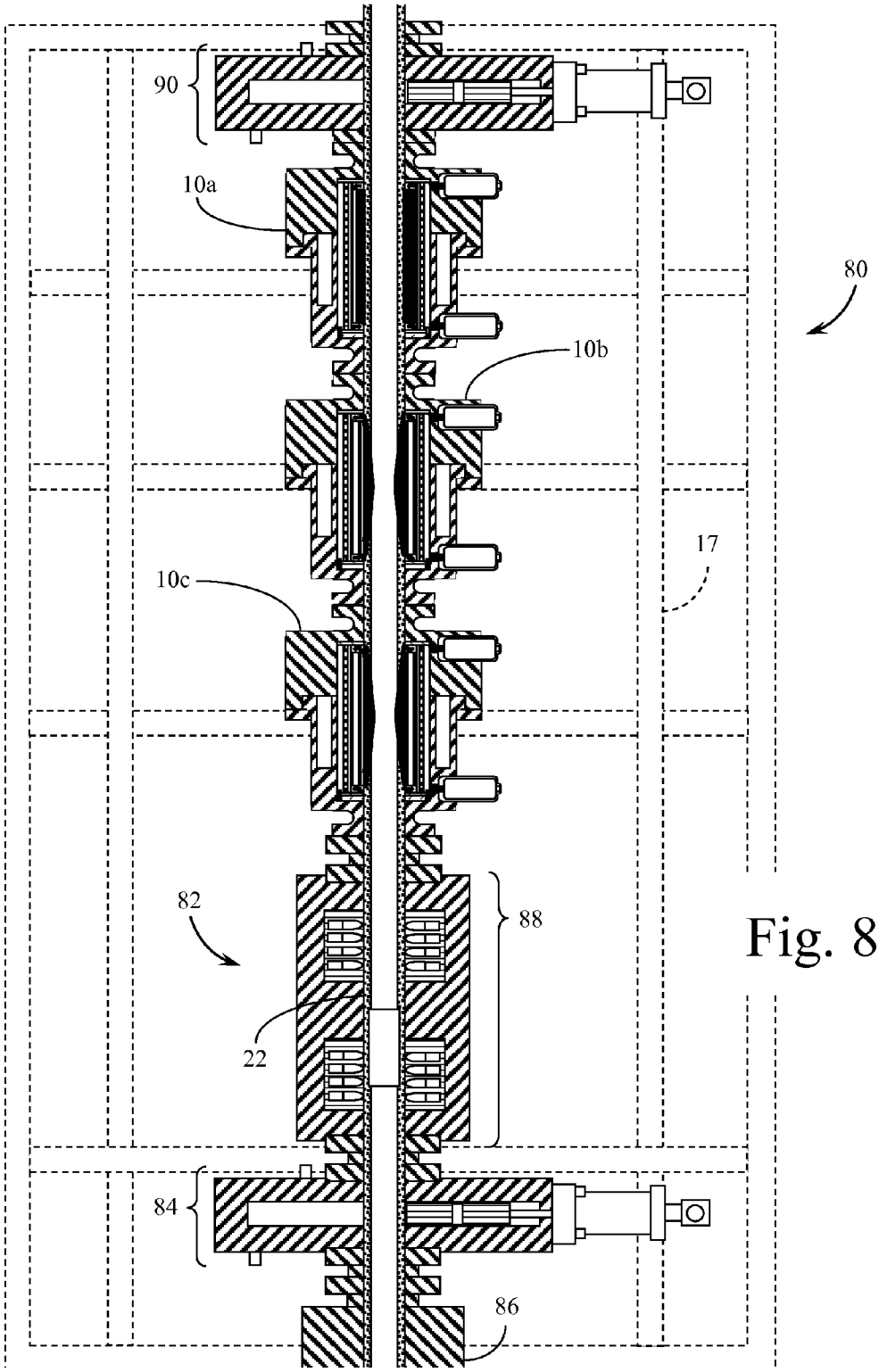
FIG. 8 is a cross-sectional view of a wellhead assembly comprising three of the ABOCs of the present invention in conjunction with a variety of other BOC valves and components.

FIG. 8 discloses wellhead superstructure 80 made up of an array of valves, BOCs and ABOCs in a configuration associated with well head 86. The components in superstructure 80 are supported by superstructure support frame 17 shown in dashed outline form for clarity. The assembly shown in FIG. 8 includes three ABOCs comprising first ABOC 10*a* positioned on top of second ABOC 10*b*, which is positioned on top of third ABOC 10*c*. This array of ABOCs is positioned on top of blowout container (BOC) 82 as may be one of a number of typical such BOCs in the field. One gate valve 84 may be positioned between the BOC assembly and wellhead 86. Shear spool 88 forms a primary component of BOC 82. All of this assembly surrounds drill pipe 22 as shown. A second gate valve 90 is positioned in what is referred to as the "dead man position" at the top of the wellhead superstructure 80. Other arrangements and numbers of ABOCs and BOCs are anticipated.

Figure 9:
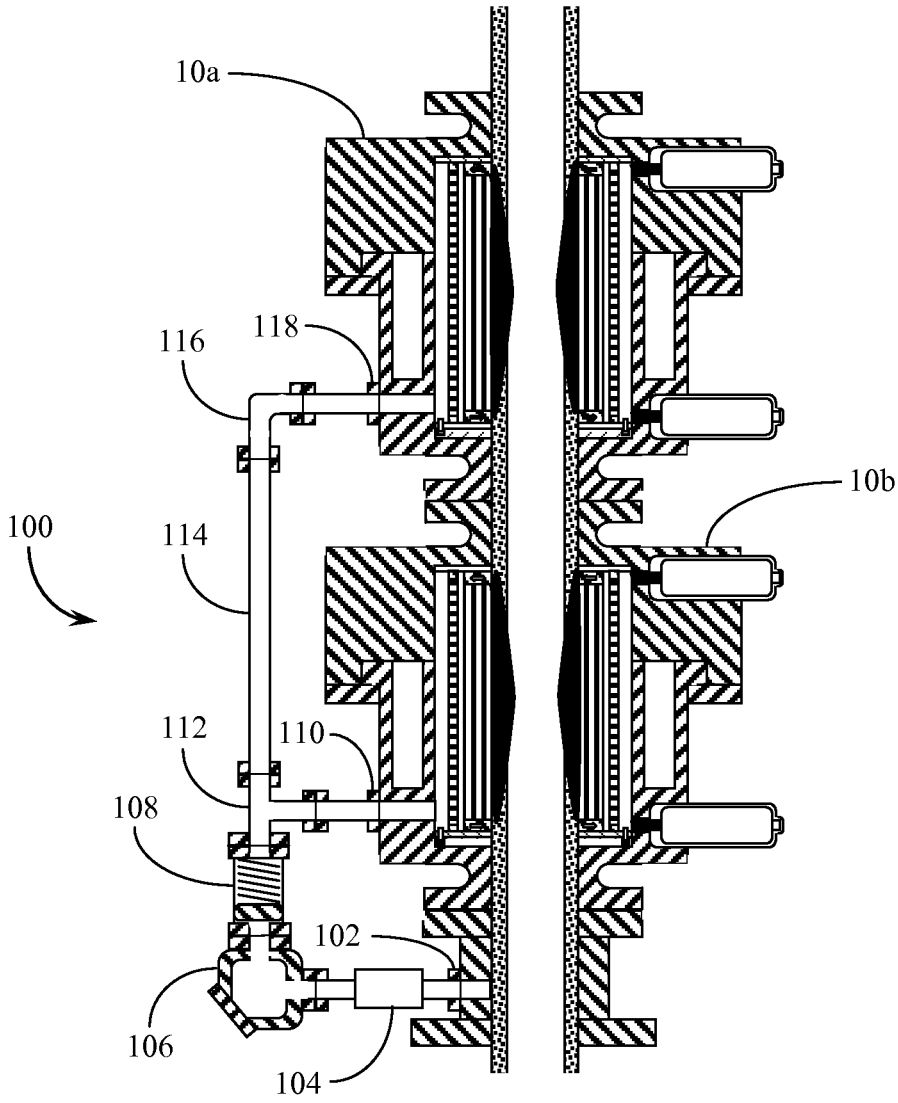
FIG. 9 is a cross-sectional view of a wellhead assembly comprising two of the ABOCs of the present invention linked together with a hydraulic back pressure system useful in conjunction with the present invention.

Reference is finally made to FIG. 9 which provides one example of a system for facilitating the placement of back pressure against the outside wall of the bladder assembly of the ABOC of the present invention. FIG. 9 shows a first ABOC 10*a* and a second ABOC 10*b* stacked as referenced in part in FIG. 8. Back pressure assembly 100 is generally constructed with flanged outlet 102 into a lower spool of the wellhead superstructure 80 assembly. This conducts the pressure of the drilling or production fluids to hydraulic valve 104 and through right angle fixture 106 to overpressure transfer piston 108. Right angle fixture 106 is preferably a forged studded connection structured to withstand the rush of high pressure fluids, gases, and solids resulting from the opening the gate valve within the wellhead system. The transfer piston 108 communicates the high pressure of the bore hole fluids to the hydraulic fluid system associated with the ABOCs. Through bladder backside port 110, the hydraulic fluid system connects by way of T fixture 112 to overpressure transfer piston 108 and additionally upward through high pressure hydraulic line 114 through L-fixture 116 to a corresponding bladder backside port 118 on the first ABOC 10*a*. In this manner, the high pressures of the drilling fluids or production fluids that may be experienced within the bore hole during a blowout condition may be transferred to the hydraulic fluids of the ABOCs to provide higher pressure hydraulic fluid that facilitates a back pressure against the bladder assemblies as described above to further strengthen the seal of the bladder against the drill pipe.

Although the present invention has been described in conjunction with certain preferred embodiments, it is anticipated that variations in both the size and geometry of the structures may be utilized without departing form the spirit and scope of the invention. To some extent, the geometry of the various components described (the height of the bladder assembly, for example) is determined by the drilling and bore hole environment within which the ABOC is intended to operate. Higher pressure environments may require larger bladder assemblies, whereas lower pressure terrestrial environments may require smaller bladder assemblies. Once again, such variations that are primarily determined by the levels of pressure associated with the operating environment do not necessarily depart from the spirit and scope of the claimed invention.

I claim:

1. An annular blowout container (ABOC) for facilitating the stoppage or restriction of the flow of fluids, solids, and gases around a pipe or tubular structure within a borehole, the ABOC comprising:

a top section body having a central bore;

a bottom section body having a central bore and at least one component chamber, the bottom section body removably attached to the top section body;

a flexible cylindrical bladder assembly, the bladder assembly comprising:

a flexible cylindrical bladder wall;

a top rotator plate fixed to the top of the flexible cylindrical bladder wall; and a bottom rotator plate fixed to the bottom of the flexible cylindrical bladder wall;

a top rotator assembly for directing a rotation of the top rotator plate of the bladder assembly; and a bottom rotator assembly for direction a counter-rotation of the bottom rotator plate of the bladder assembly;

wherein the counter-rotation of the top and bottom rotator plates effects a twisting of the flexible bladder wall and the constriction of the bladder wall around the pipe or tubular structure within the central bore.

* * * * *